US006843621B2

(12) United States Patent
Burnette

(10) Patent No.: US 6,843,621 B2
(45) Date of Patent: Jan. 18, 2005

(54) REAMER

(76) Inventor: Wayne Board Burnette, 3103 Crab Orchard Rd., Huddleston, VA (US) 24104

( * ) Notice: Subject to any disclaimer, the term of this patent is extended or adjusted under 35 U.S.C. 154(b) by 128 days.

(21) Appl. No.: 10/162,097

(22) Filed: Jun. 4, 2002

(65) Prior Publication Data

US 2002/0164219 A1 Nov. 7, 2002

Related U.S. Application Data

(63) Continuation-in-part of application No. 10/128,386, filed on Apr. 23, 2002.

(60) Provisional application No. 60/297,184, filed on Jun. 11, 2001, and provisional application No. 60/285,623, filed on Apr. 23, 2001.

(51) Int. Cl.[7] ..... B23B 51/00

(52) U.S. Cl. ..... 408/227; 408/82; 408/197; 408/231; 408/713

(58) Field of Search ..... 408/1 R, 82, 196, 408/197, 198, 199, 227, 231, 713, 233; 76/101.1, 108.1, 115; 29/402.01

(56) References Cited

U.S. PATENT DOCUMENTS

| | | | | | |
|---|---|---|---|---|---|
| 330,508 | A | * | 11/1885 | Price | 408/233 |
| 1,062,114 | A | * | 5/1913 | Neale | 408/198 |
| 1,600,770 | A | * | 9/1926 | Metzger | 408/155 |
| 1,873,177 | A | * | 8/1932 | Beard | 408/200 |
| 1,919,745 | A | * | 7/1933 | Raphael | 408/233 |
| 1,946,584 | A | * | 2/1934 | Judge | 408/82 |
| 1,951,100 | A | * | 3/1934 | John | 408/186 |
| 2,188,584 | A | * | 1/1940 | Tyne | 408/223 |
| 4,114,484 | A | * | 9/1978 | Feamster, III | 408/104 |
| 4,560,309 | A | | 12/1985 | Hornsby | |
| 4,740,121 | A | | 4/1988 | Arnold | |
| 5,800,437 | A | | 9/1998 | Gustilo et al. | |

FOREIGN PATENT DOCUMENTS

| | | | | |
|---|---|---|---|---|
| DE | 1961862 | * | 6/1971 | 408/227 |

* cited by examiner

*Primary Examiner*—Daniel W. Howell
(74) *Attorney, Agent, or Firm*—Donavon Lee Favre

(57) ABSTRACT

A tapered reamer is disclosed. The reamer is used to make a tapered opening in a cylinder used in a crossing gate repair kit. A straight reamer is also disclosed.

2 Claims, 6 Drawing Sheets

REAMER

BACKGROUND OF THE INVENTION

The present invention is disclosed at least in part in Provisional Application serial No. 60/297184 filed Jun. 11, 2001 and priority is claimed based upon the Provisional Application. The present application is a continuation in part of co-pending application Ser. No. 10/128386 filed Apr. 23, 2002 which in turn claims priority of Provisional Application serial No. 60/285623 filed Apr. 23, 2001.

U.S. Pat. No. 4,560,309 discloses at the abstract "This invention relates to a tapered finishing reamer"

U.S. Pat. No. 5,800,437 discloses at the abstract placing a cannulated reamer over a centering rod. See also FIG. 3.

U.S. Pat. No. 4,740,121 discloses a tapered reamer having a guide portion. See FIG. 1 and FIG. 1*a*.

BRIEF SUMMARY OF THE INVENTION

The present invention is directed to an angled or tapered reamer. The reamer was initially designed to ream a truncated cone shaped opening in a cylinder used to repair a railroad crossing gate. After the gate falls off due to impact, the cylinder is placed on the gate pivot and a lever arm is inserted in the cylinder and used to retract the gate raising mechanism to a lowered gate position in order for a functional gate to be placed on the pivot. The reamer is preferably a tapered reamer but can also be a straight reamer.

DETAILED DESCRIPTION

Figure 1:
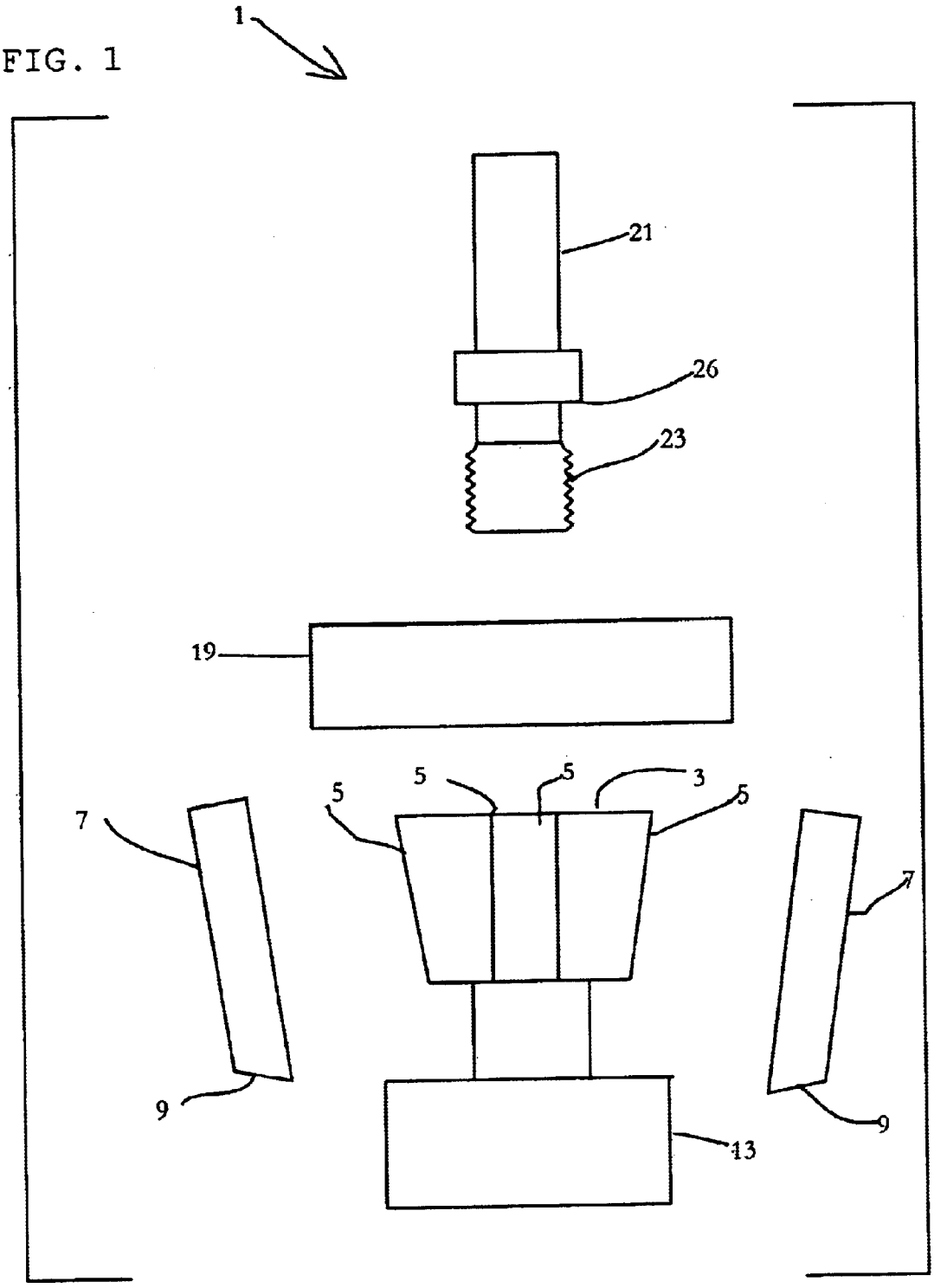
FIG. 1 is an exploded view of the tapered reamer of the present invention.
Figure 2:
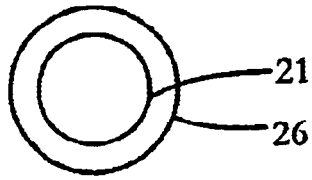
FIG. 2 is a top view of the reamer arbor.
Figure 3:
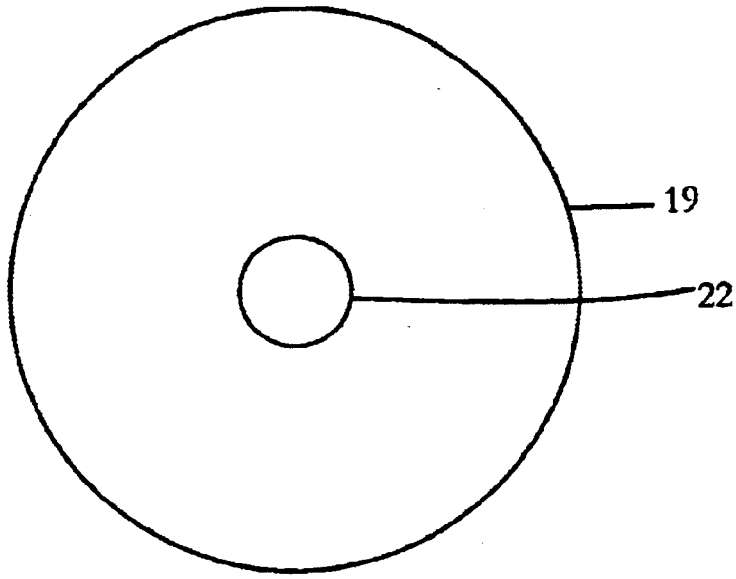
FIG. 3 is a top view of the top or arbor end of the reamer.
Figure 4:
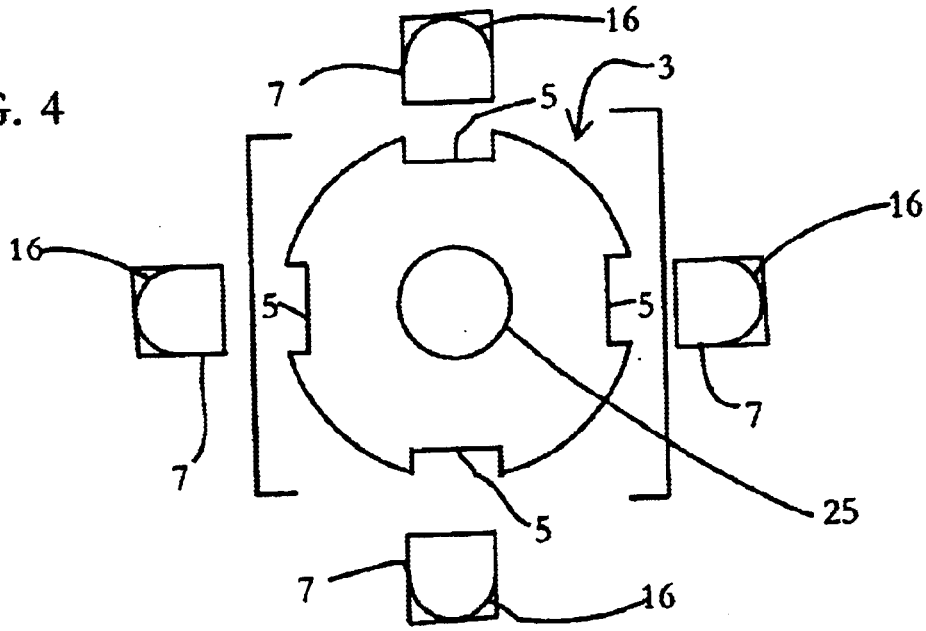
FIG. 4 is a top view of reamer body and cutter bits.
Figure 5:
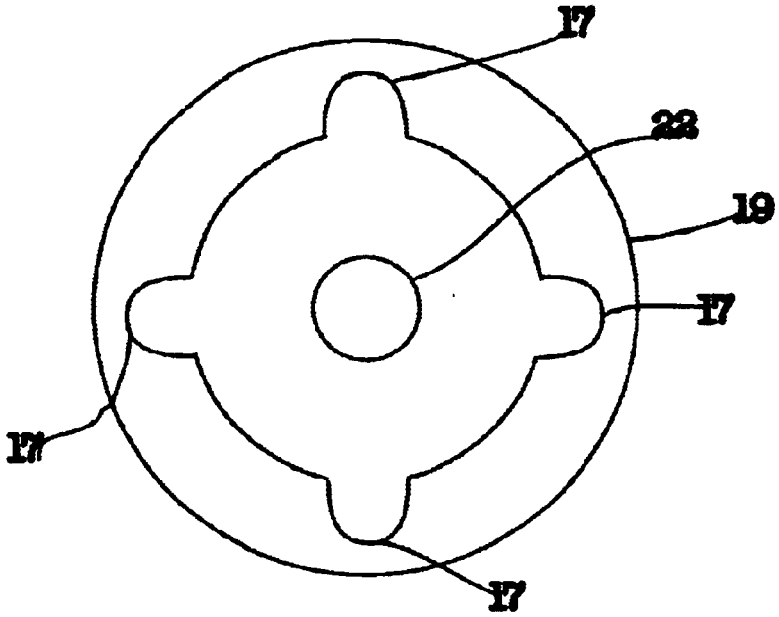
FIG. 5 is a bottom view of the arbor end of the reamer.
Figure 6:
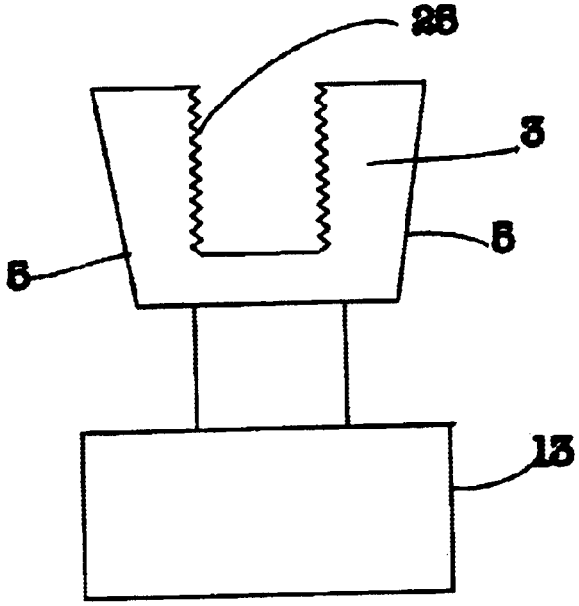
FIG. 6 is a cross sectional view of the reamer body.
Figure 7:
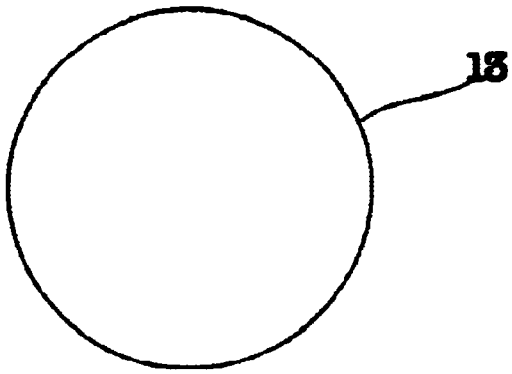
FIG. 7 is a bottom view of the pilot end of the reamer.

Turning now to FIG. 1, there is shown an exploded view of the tapered reamer 1 of the present invention. The body 3 of reamer 1 has four cutter slots 5 for lathe bits 7 which are three eights inch by three eights inch HSSteel angled to cut in the direction of rotation (See FIG. 4). The bits 7 are also angled at the bottom end 9, to fit into angled recess 11 in the lower pilot end 13 of the body of reamer body 3 (Sec FIG. 5). The upper ends 15 of bits 7 are rounded 16 to fit into corresponding rounded recesses 17 in the top or arbor end 19 (See FIGS. 4 and 5). The arbor end 19 is held to the body by arbor 21 through hole 22 (see FIG. 3). Arbor 21 is preferably about 4 inches long and has a threaded end 23 which mates with a threaded recess 25 in body 3 (See FIG. 6). Flange 26 holds arbor end 19 against body 3.

In use to make the crossing gate repair kit, a hole the diameter of the pilot end 13 is bored into a cylinder. The pilot end 13 is inserted into the hole and the rotation of reamer 1 reams a conical opening in the cylinder. The arbor end 19 acts as a stop to limit the depth of cut. An opening for a lever is cut through the diameter of the cylinder. The cylinder is then placed on a conical pivot for a crossing gate. A lever is then inserted into the cylinder and the crossing gate mechanism is returned to the gate down position for replacement of the gate.

Figure 8:
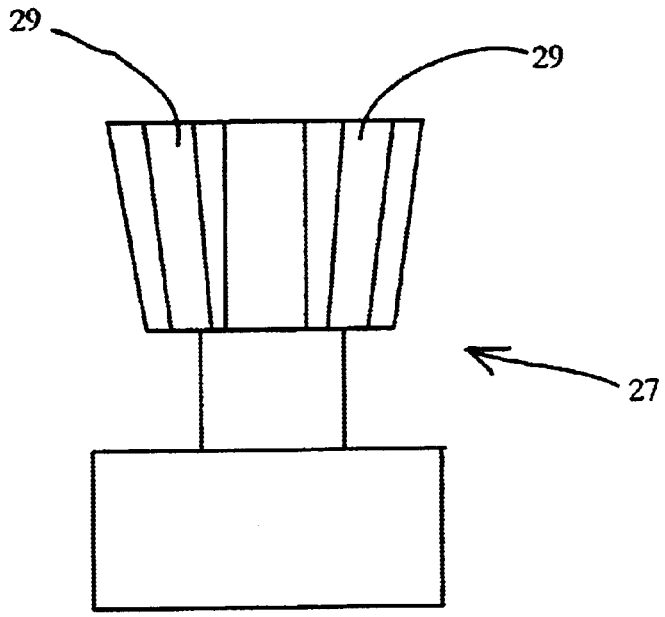
FIG. 8 is a view of the reamer body having additional slots for alternate cutters.
Figure 9:
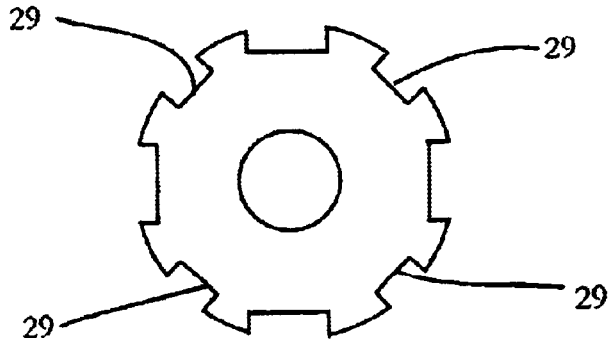
FIG. 9 is a top view of the body of FIG. 8.
Figure 10:
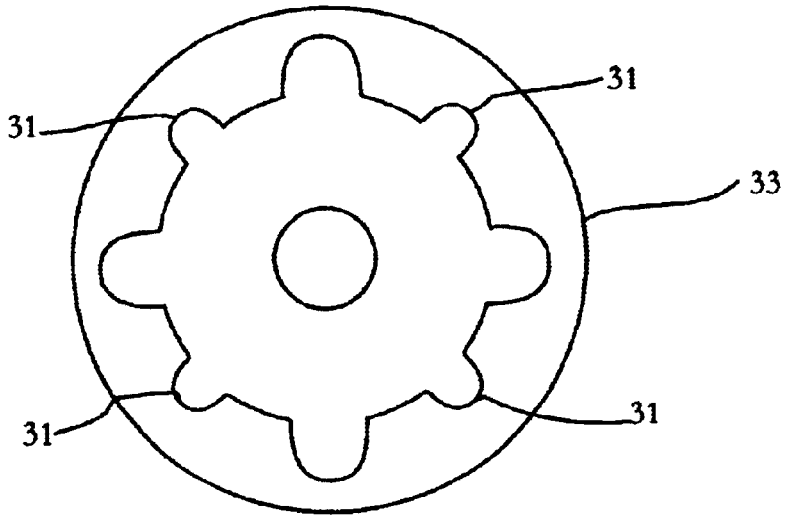
FIG. 10 is a bottom view of the arbor end of the reamer of FIG. 8.
Figure 11:
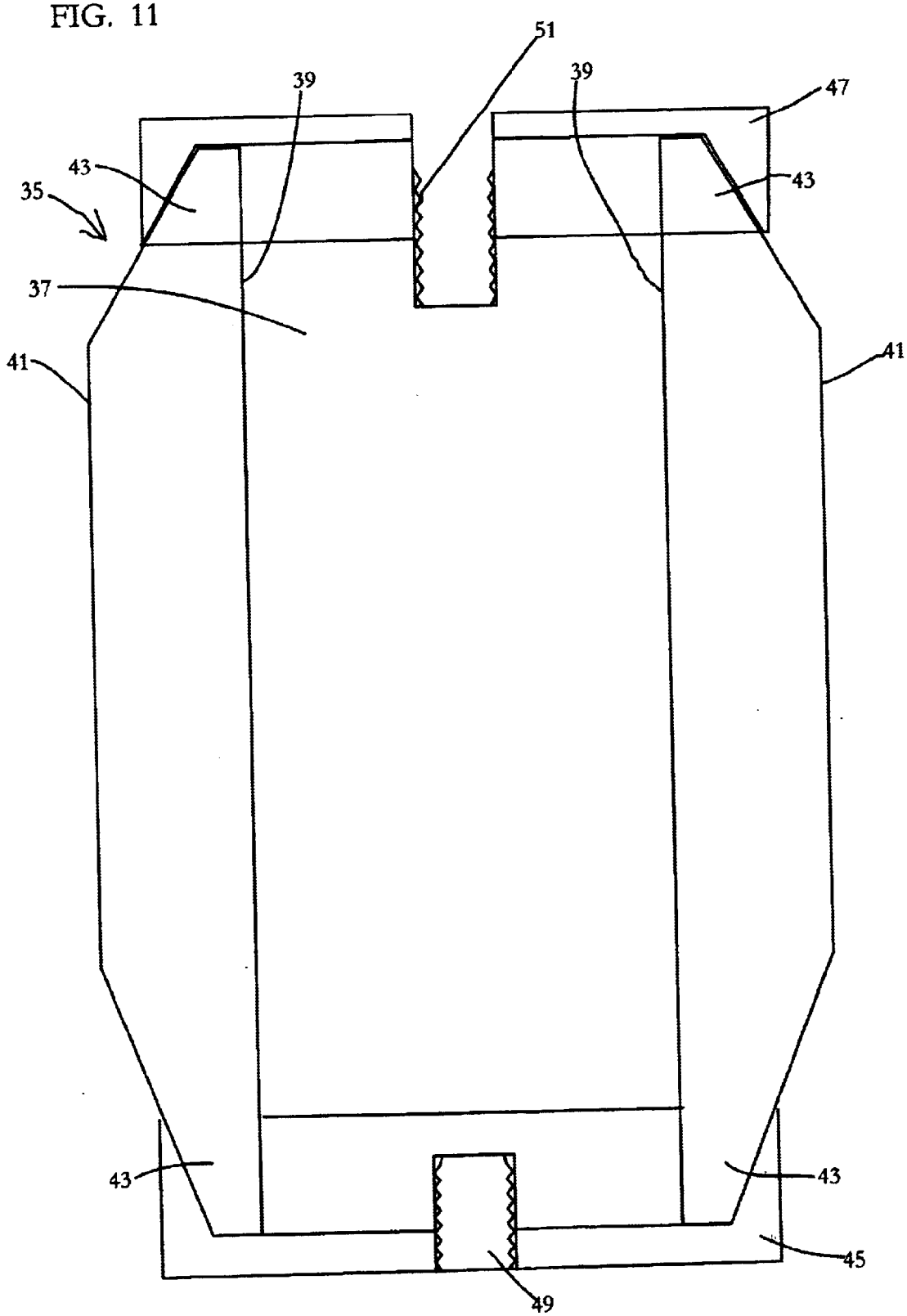
FIG. 11 is a cross sectional view of a straight reamer of the present invention.
Figure 12:
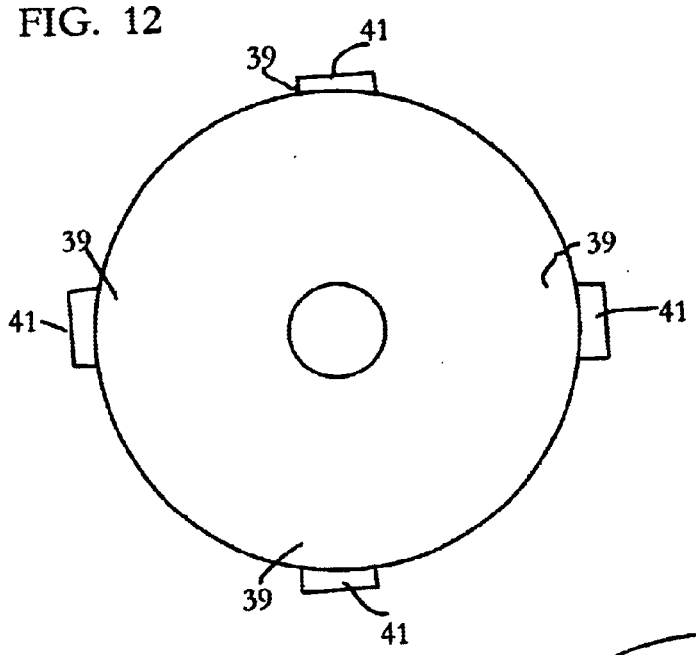
FIG. 12 is top view of the reamer of FIG. 11.
Figure 13:
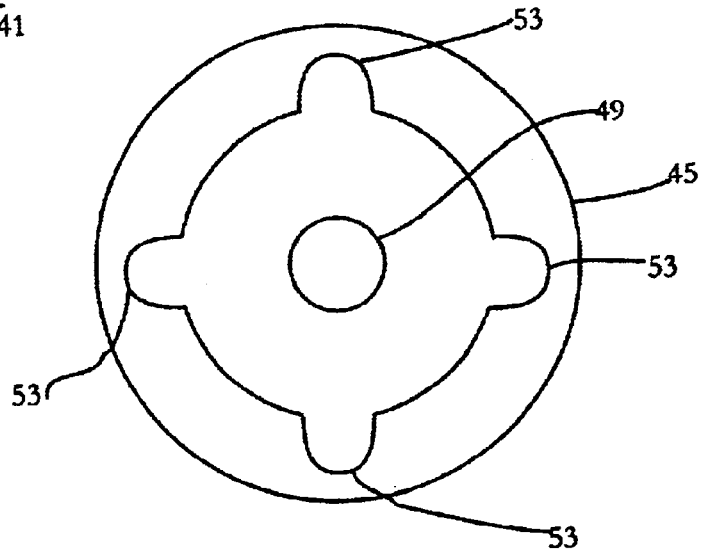
FIG. 13 is a bottom view of inverted cup top end of the reamer of FIG. 11.
Figure 14:
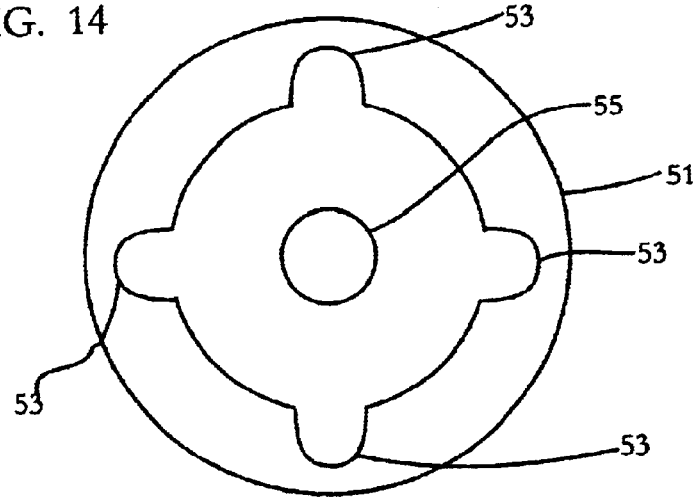
FIG. 14 is a top view of the cup bottom end of the reamer of FIG. 11.

Turning now to FIGS. 8, 9, and 10, there is shown another embodiment of the present invention. The reamer body 27 has four additional slots 29 for the insertion of tungsten carbide cutters (not shown). The tungsten carbide cutters have the same general configuration as the lathe bits 7 but are usually narrower. Rounded recesses 31 of top end 33 receive the upper ends of the tungsten carbide cutters. Either set of cutters can be used, but preferably not both at the same time.

Turning now to FIGS. 11, 12, 13 and 14, there is shown another embodiment of the present invention, a straight reamer 35. The straight reamer body 37 has four slots 39 for the insertion of cutters 41. The cutters 41 have tapered ends 43 and are held in place on straight reamer body 37 by cup bottom end 45 and inverted cup upper end 47. Recess 53 holds tapered ends 45 in place. Cup bottom end 45 is held onto straight reamer body 37 by setscrew 49. Inverted cup upper end is held in place onto straight reamer body 37 by mandrel 21 shown in FIG. 11 screwed into threads 51 of straight reamer body 37.

The tapered reamer 1 of the present invention can come in a kit form with different degree cutter bodies to obtain the desired angular degree in special jobs.

The retainers can be made to accept the straight arbor end as shown or it can accept MT or R8 arbors so they can be used in a milling machine with an R8 arbor or in a metal lathe with straight or Marse taper which is M.T. '. 1-2-3-4-5.

The carbide cutters are one-fourth inch wide or a size desired by the manufacturer.

The reamers of the present invention have multiple uses, and can be changed from one angle to another in a very short down time. Also it takes very little time to change cutters.

What is claimed is:

1. A reamer for making a tapered hole comprising:

a) a conical body having a longitudinal axis, and a threaded opening along the longitudinal axis, b) a plurality of cutter slots spaced from each other about the longitudinal axis, c) cutter bits positioned in the cutter slots, d) a pilot end attached to the conical body, e) recesses in the pilot end which receive ends of the cutter bits and maintain the cutter bits in position, f) an arbor end having a centered opening for the insertion of an arbor, g) an arbor having a threaded end for insertion of the arbor, h) a flange on the arbor, the flange having an outer diameter larger than the centered opening to hold the arbor in place when the threaded end of the arbor is screwed into the threaded opening of the conical body, i) recesses in the arbor end to receive ends of the cutter bits and maintain the cutter bits in position.

2. A reamer for making a straight cylindrical hole comprising:

a) a body having a uniform diameter along a majority of its longitudinal axis, and a threaded opening along the longitudinal axis, b) a plurality of cutter slots spaced from each other about the longitudinal axis, c) cutter bits positioned in the cutter slots, d) an arbor end having a centered opening for the insertion of an arbor, e) an arbor having a threaded end for insertion of the arbor, f) a flange on the arbor, the flange having an outer diameter larger than the centered opening to hold the arbor in place when the threaded end of the arbor is screwed into the threaded opening of the conical body, g) recesses in the arbor end to receive ends of the cutter bits and maintain the cutter bits in position, and h) an end opposed to the arbor end having recesses to receive ends of the cutter bits and maintain the cutter bits in position.

* * * * *